US008113020B2

(12) United States Patent
Liu et al.

(10) Patent No.: US 8,113,020 B2
(45) Date of Patent: Feb. 14, 2012

(54) LOCK AND ELECTRONIC DEVICE USING THE SAME

(75) Inventors: Yu-Rong Liu, Shenzhen (CN); Xiao-Feng Yang, Shenzhen (CN); You-Xiang Ding, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 57 days.

(21) Appl. No.: 12/764,919

(22) Filed: Apr. 21, 2010

(65) Prior Publication Data

US 2011/0041578 A1 Feb. 24, 2011

(30) Foreign Application Priority Data

Aug. 19, 2009 (CN) ..... 2009 1 0305798

(51) Int. Cl.
*E05B 9/04* (2006.01)
*E05B 15/00* (2006.01)

(52) U.S. Cl. ..... 70/58; 70/14; 70/386; 70/38 A; 70/34; 70/120; 70/389; 70/365; 70/366; 70/49; 70/18; 292/137; 292/169; 292/140; 292/50; 292/40

(58) Field of Classification Search ..... 70/14, 58, 70/386, 38 A, 34, 120, 389, 365, 366; 292/137, 292/169, 140, 50, 40, 288, 1
See application file for complete search history.

(56) References Cited

U.S. PATENT DOCUMENTS

| | | | | | |
|---|---|---|---|---|---|
| 1,908,980 | A * | 5/1933 | Heyel | 70/120 |
| 1,977,853 | A * | 10/1934 | Kemp | 70/118 |
| 2,936,606 | A * | 5/1960 | Welch et al. | 70/134 |
| 3,026,703 | A * | 3/1962 | Welch | 70/134 |
| 3,469,874 | A * | 9/1969 | Mercurio | 292/5 |
| 4,756,177 | A * | 7/1988 | Widen | 70/493 |
| 6,006,557 | A * | 12/1999 | Carl et al. | 70/58 |
| 6,237,376 | B1 * | 5/2001 | Surratt | 70/34 |
| 7,353,672 | B2 * | 4/2008 | Lu | 70/58 |
| 7,497,103 | B1 * | 3/2009 | Misner | 70/103 |
| 7,526,932 | B2 * | 5/2009 | Funtmann | 70/58 |
| 7,958,760 | B2 * | 6/2011 | Widen | 70/378 |

* cited by examiner

*Primary Examiner* — Lloyd Gall
*Assistant Examiner* — Ifeolu Adeboyejo
(74) *Attorney, Agent, or Firm* — Altis Law Group, Inc.

(57) ABSTRACT

A lock includes a housing, a cover, a lock cylinder holder, a lock cylinder, a cam, a resisting shaft, at least one latching block, and at least one first elastic member. The cover is secured to one end of the housing. A gap is formed between the cover and the housing. The lock cylinder holder is secured to the housing. The lock cylinder is rotatably mounted in the lock cylinder holder. The cam is received in the housing and secured to the lock cylinder. The resisting shaft is rotatably mounted in the housing and includes a frustum shaped end. The latching block is received in the gap. The latching block includes an inclined surface corresponding to the frustum shaped end. The first elastic member is configured to connect the latching block to the cover or the housing. An electronic device using the lock is also provided.

14 Claims, 10 Drawing Sheets

LOCK AND ELECTRONIC DEVICE USING THE SAME

BACKGROUND

1. Technical Field

The present disclosure relates to locks and electronic devices and, particularly, to a lock and an electronic device using the lock.

2. Description of Related Art

During travelling, users may leave an electronic device, for example a portable computer, unattended to take care of other matters, making it vulnerable to be stolen.

BRIEF DESCRIPTION OF THE DRAWINGS

The components of the drawings are not necessarily drawn to scale, the emphasis instead being placed upon clearly illustrating the principles of a lock and an electronic devices using the same. Moreover, in the drawings, like reference numerals designate corresponding parts throughout several views.

DETAILED DESCRIPTION

Figure 1:
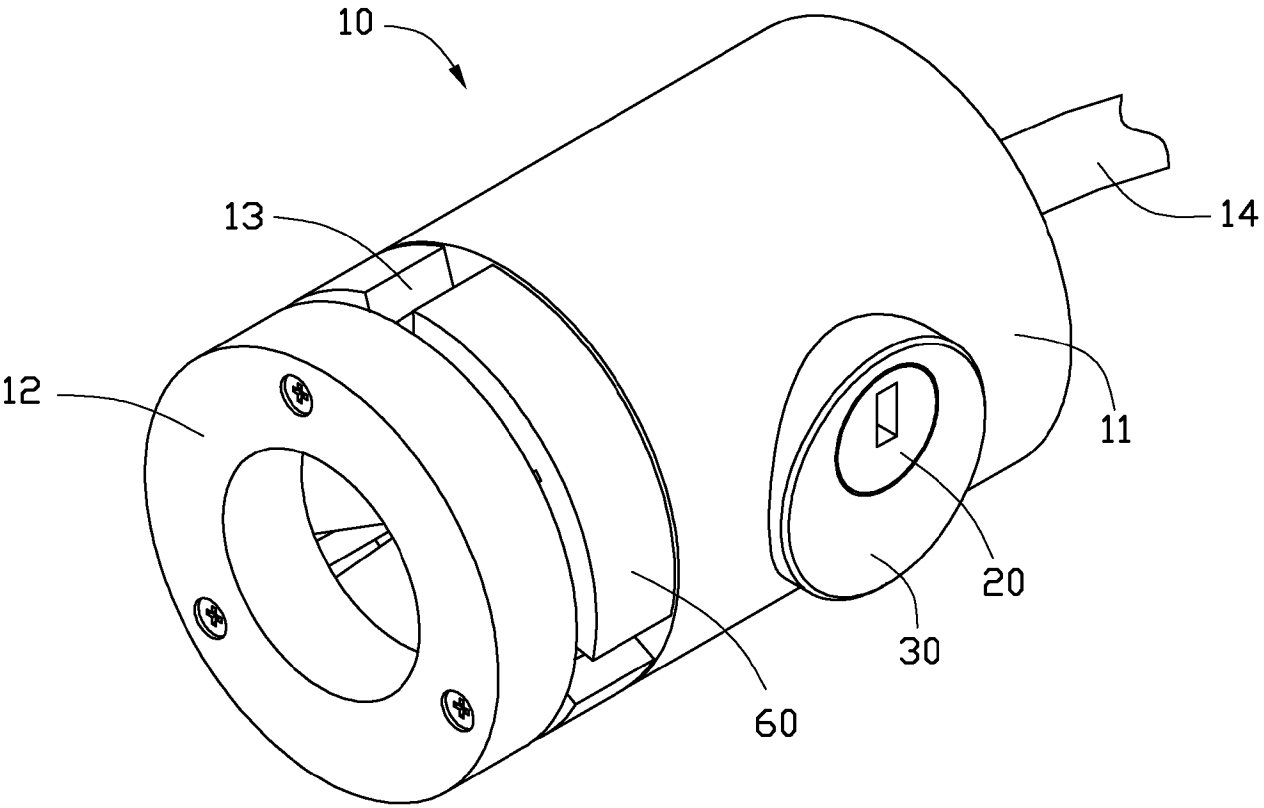
FIG. 1 is an isometric view of a lock in accordance with an exemplary embodiment.
Figure 2:
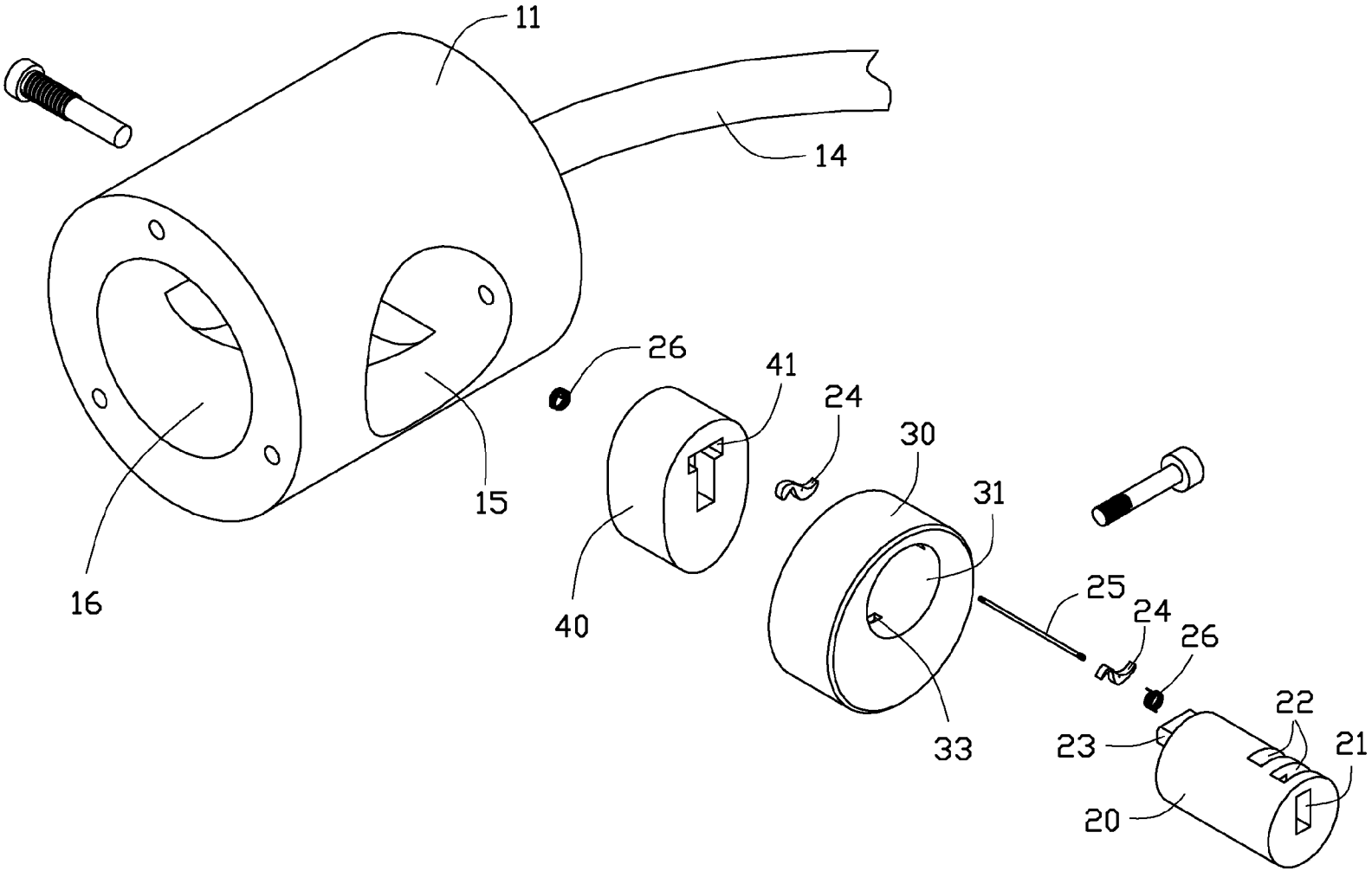
FIG. 2 is a partially exploded, perspective view of the lock of FIG. 1, showing some elements of the lock.
Figure 3:
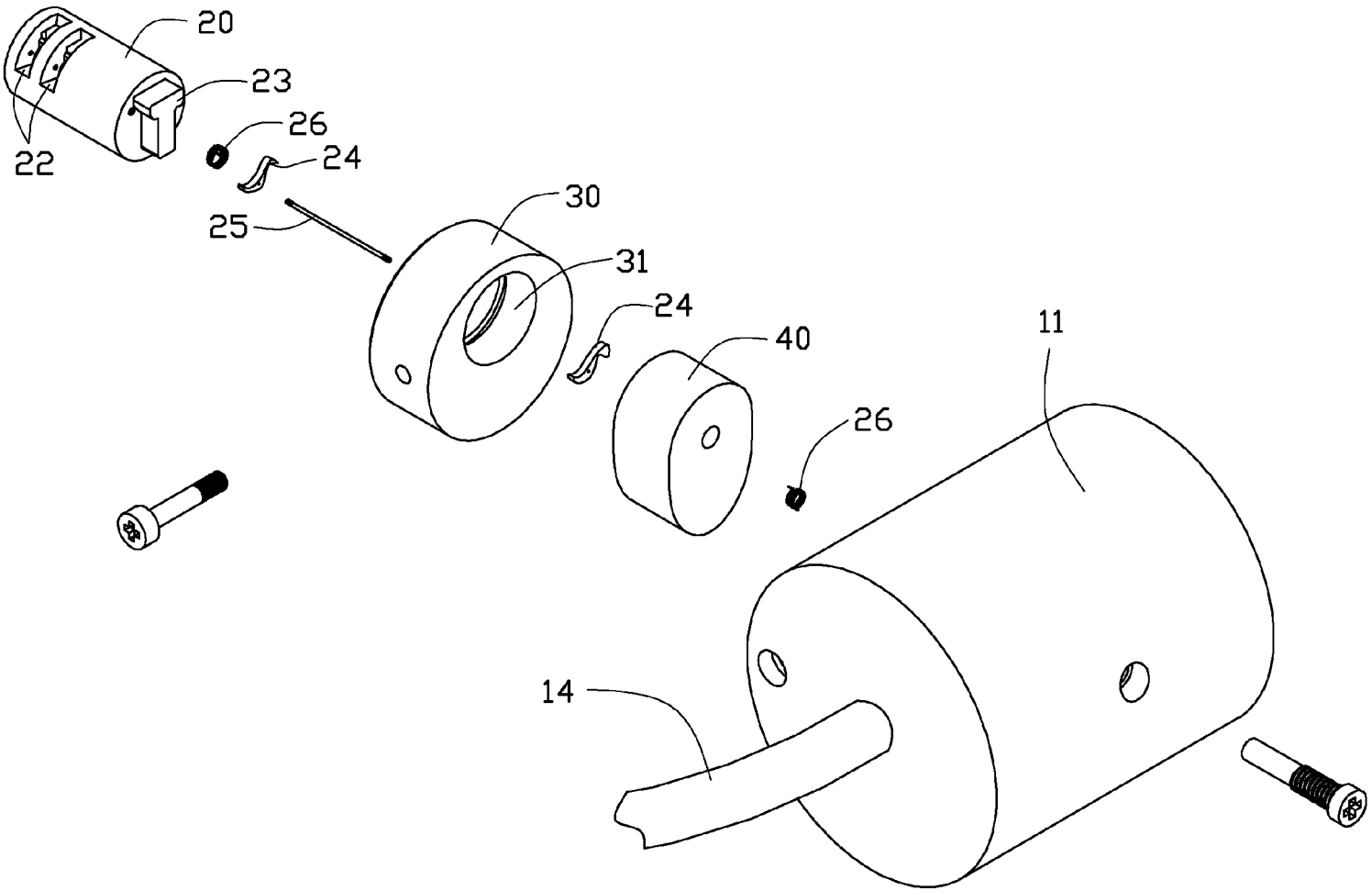
FIG. 3 is similar to FIG. 2, but viewed from another viewpoint.
Figure 4:
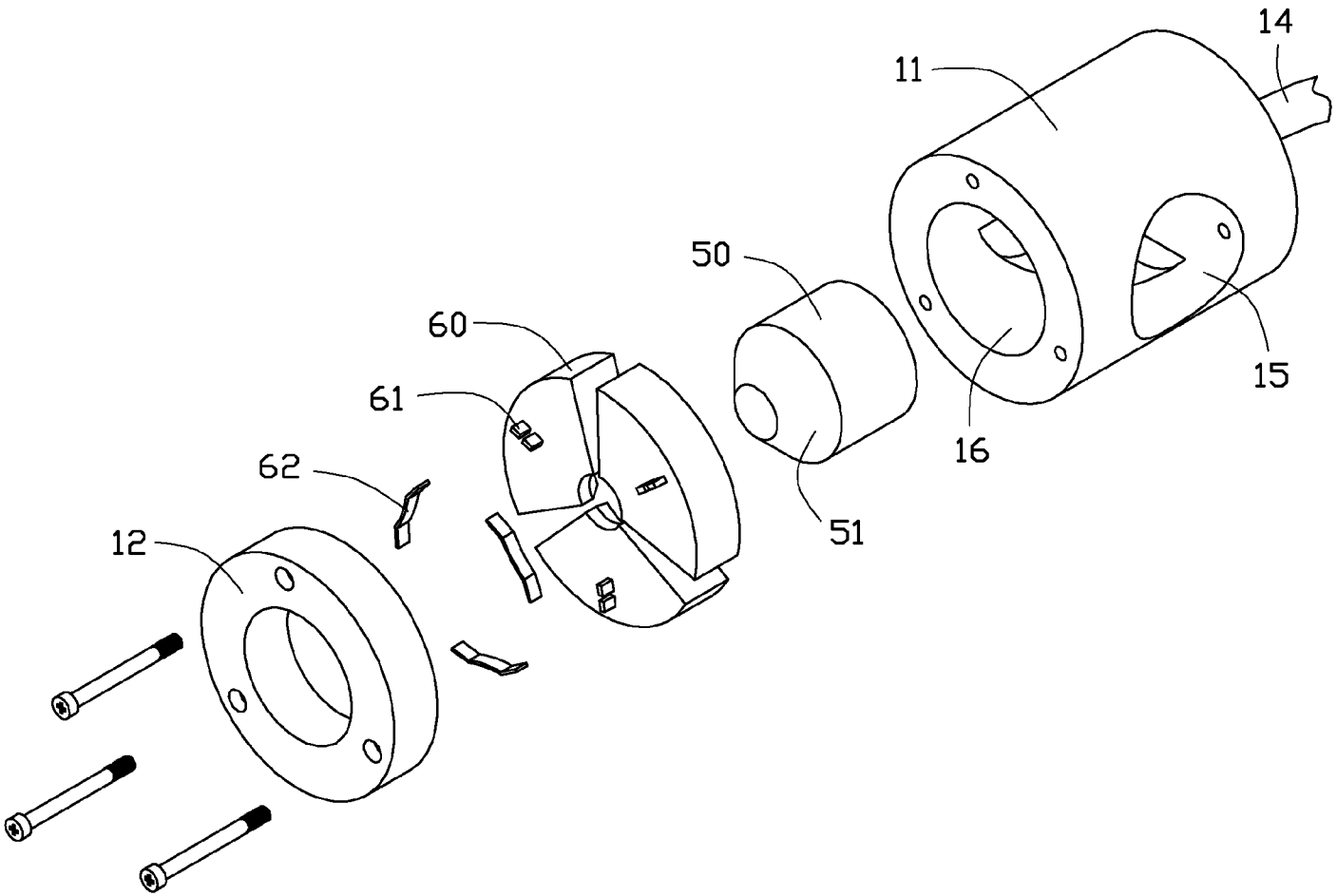
FIG. 4 is another partially exploded, perspective view of the lock of FIG. 1, showing some elements of the lock.
Figure 5:
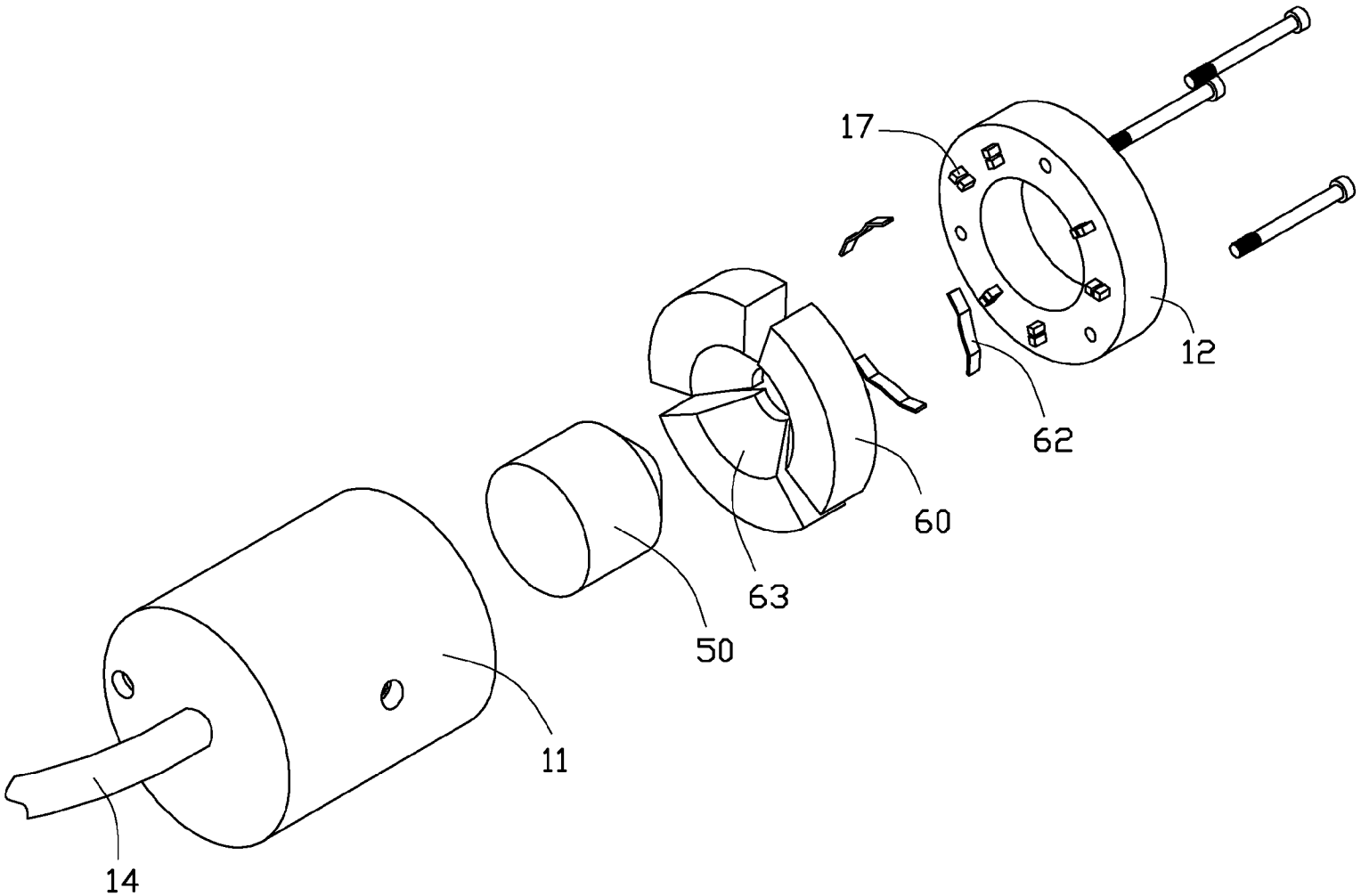
FIG. 5 is similar to FIG. 4 but viewed from another viewpoint.

Referring to FIGS. 1-5, an embodiment of a lock 10 is illustrated. In the embodiment, the lock 10 is substantially cylindrical. The lock 10 includes a housing 11 and a cover 12. The housing 11 cooperates with the cover 12 to receive a lock cylinder 20, a lock cylinder holder 30, a cam 40, a resisting shaft 50, and at least one latching block 60. The lock 10 further includes a cable 14. One end of the cable 14 is secured to one end of the housing 11, and an opposite end is secured to an external apparatus such as a desk.

The housing 11 is substantially cylindrical. The housing 11 defines a first receiving space 15 and a second receiving space 16. One end of the first receiving space 15 is defined in a lateral surface of the housing 11. One end of the second receiving space 16 is defined in one end of the housing 11 facing the cover 12. The first receiving space 15 is perpendicular to and communicates with the second receiving space 16. The first receiving space 15 is configured to receive the cam 40, the lock cylinder holder 30, and the lock cylinder 20. The second receiving space 16 is configured to receive the resisting shaft 50.

The cover 12 is a ring-shaped. The cover 12 is secured to the end of the housing 11 defining the second receiving space 16, and a gap 13 is formed between the cover 12 and the housing 11. The at least one latching block 60 is received in the gap 13. A plurality of first latching protrusions 17 protrudes from one end of the cover 12 facing the housing 11. Each of the first latching protrusions 17 defines a slot (not labeled) for latching a portion of a first elastic member 62. In the embodiment, two latching protrusions 17 are employed to latch one of the first elastic members 62. In an alternative embodiment, the first latching protrusions 17 may protrude from the end of the housing 11 facing the cover 12.

The lock cylinder 20 is generally cylindrical. One end of the lock cylinder 20 defines a key hole 21 to receive a key (not shown). At least one slot 22 is formed in the cylinder 20 extending around a lateral surface thereof. In the embodiment, the number of the slots 22 is two. The slots 22 are parallel to each other. Each of the slots 22 communicates with the key hole 21. Each of the slots 22 receives a second elastic member 26 and a hook member 24. A shaft 25 passes through the lock cylinder 20 to connect the second elastic members 26 and the hook members 24 to the lock cylinder 20. In the embodiment, each of the second elastic members 26 is a coil spring. Each of the hook members 24 includes two hooks. One of the hooks faces one direction, and the other hook faces an opposite direction. A T-shaped projection 23 protrudes from an opposite end of the lock cylinder 20.

The lock cylinder holder 30 defines a through hole 31 to receive the lock cylinder 20. At least two columns of recessed portions 33 are formed in the inner lateral surface of the through hole 31. In the embodiment, each of the columns of the recessed portions 33 includes two recessed portions 33 corresponding to the slots 22.

One end of the cam 40 defines a T-shaped opening 41 adapted to receive the T-shaped projection 23, which secures the lock cylinder 20 to the cam 40.

The resisting shaft 50 is generally cylindrical. The resisting shaft 50 includes a frustum shaped end 51 for resisting the at least one latching block 60.

In the embodiment, the number of the latching blocks 60 is three. Each of the latching blocks 60 is substantially sector-shaped. The radius of each of the latching blocks 60 is equal to or less than that of the housing 11. Each of the latching blocks 60 includes an inclined surface 63. Each of the inclined surfaces 63 is inclined opposite to the frustum shaped end 51, so that they can match up with and resist each other. A second latching protrusion 61 protrudes from one end of each of the latching blocks 60 facing the cover 12. In an alternative embodiment, if the first latching protrusions 17 protrude from the housing 11, the second latching protrusion 61 protrudes from an opposite end of each of the latching blocks 60. Each of the second latching protrusions 61 defines a slot (not labeled) for latching a portion of one of the first elastic members 62. Each of the second latching protrusions 61 cooperates with two corresponding first latching protrusions 17 to secure one of the first elastic members 62. After the latching blocks 60 are connected to the cover 12 via the first elastic members 62, and the cover 12 is secured to the housing 11, the latching blocks 60 is retained within the gap 13.

Figure 6:
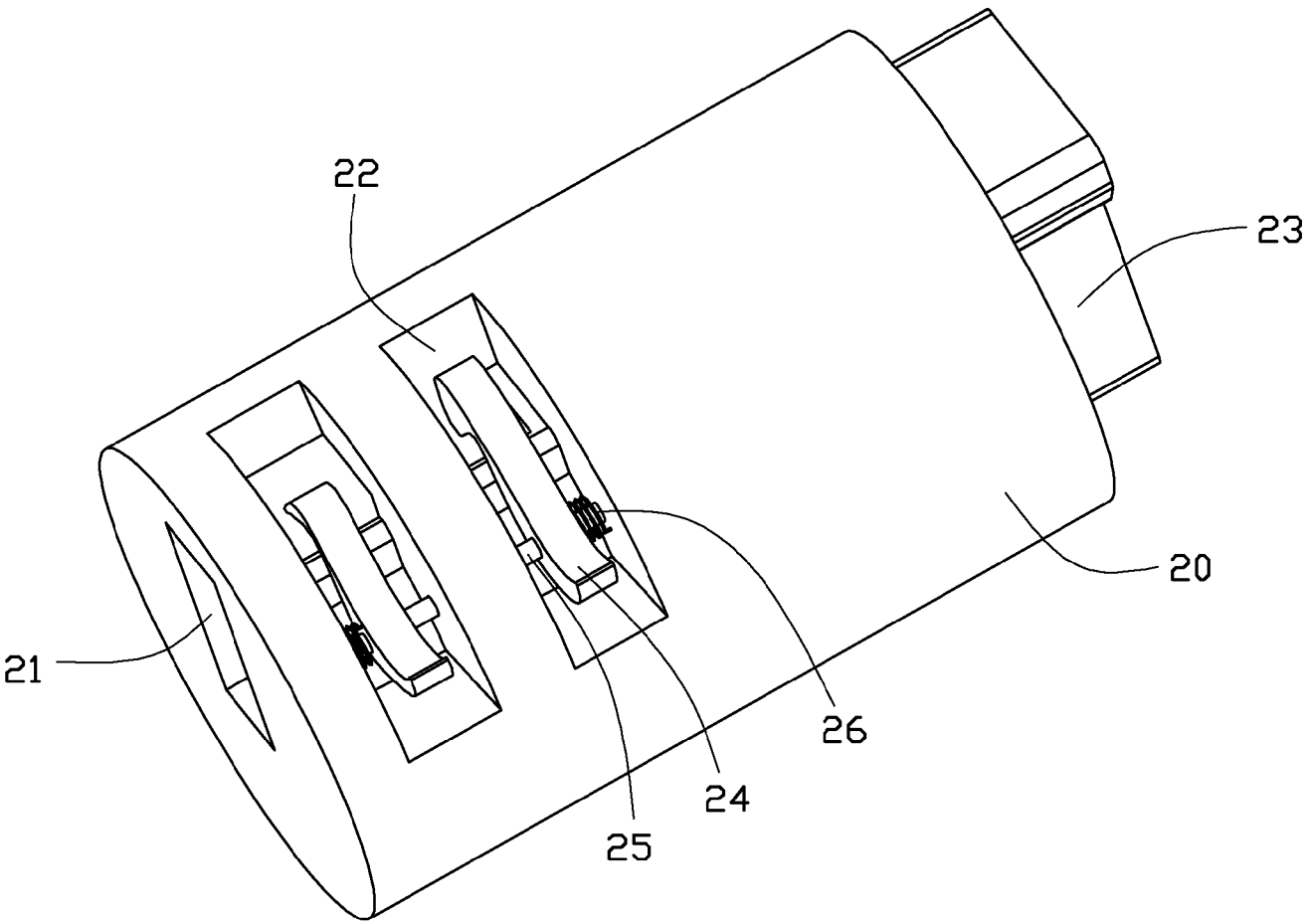
FIG. 6 is an isometric view of a lock cylinder of the lock of FIG. 1.
Figure 7:
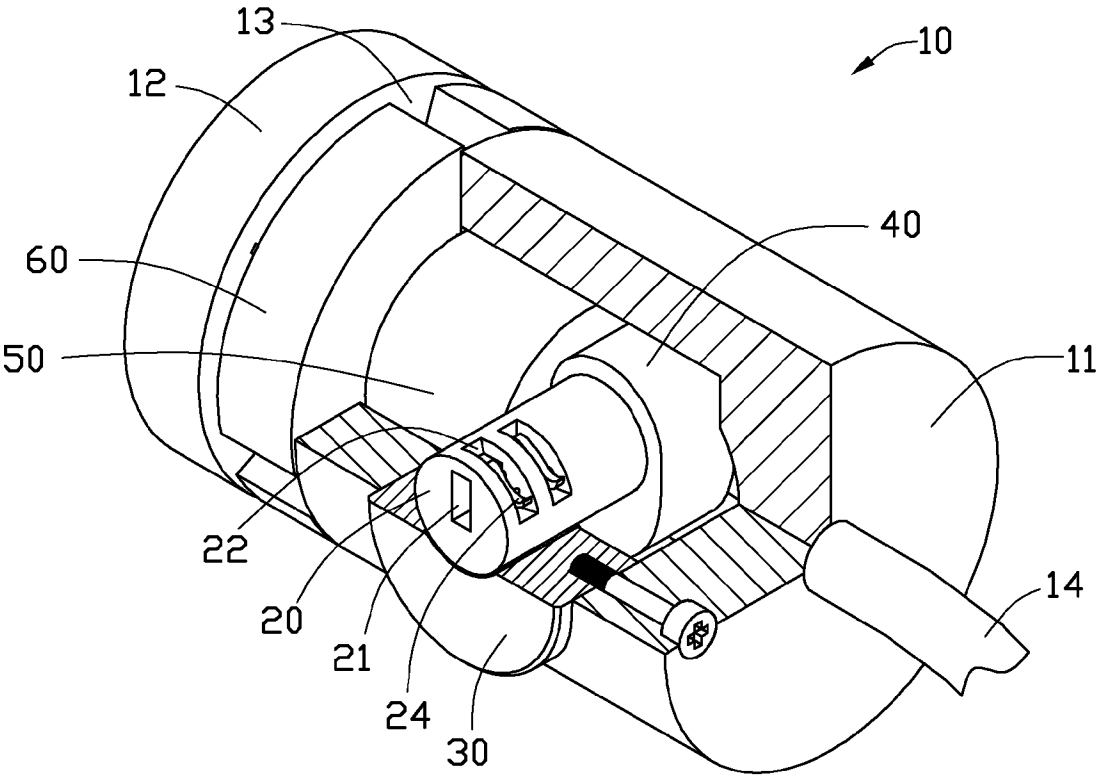
FIG. 7 is a cut-away view of the lock cylinder of the lock of FIG. 1.
Figure 8:
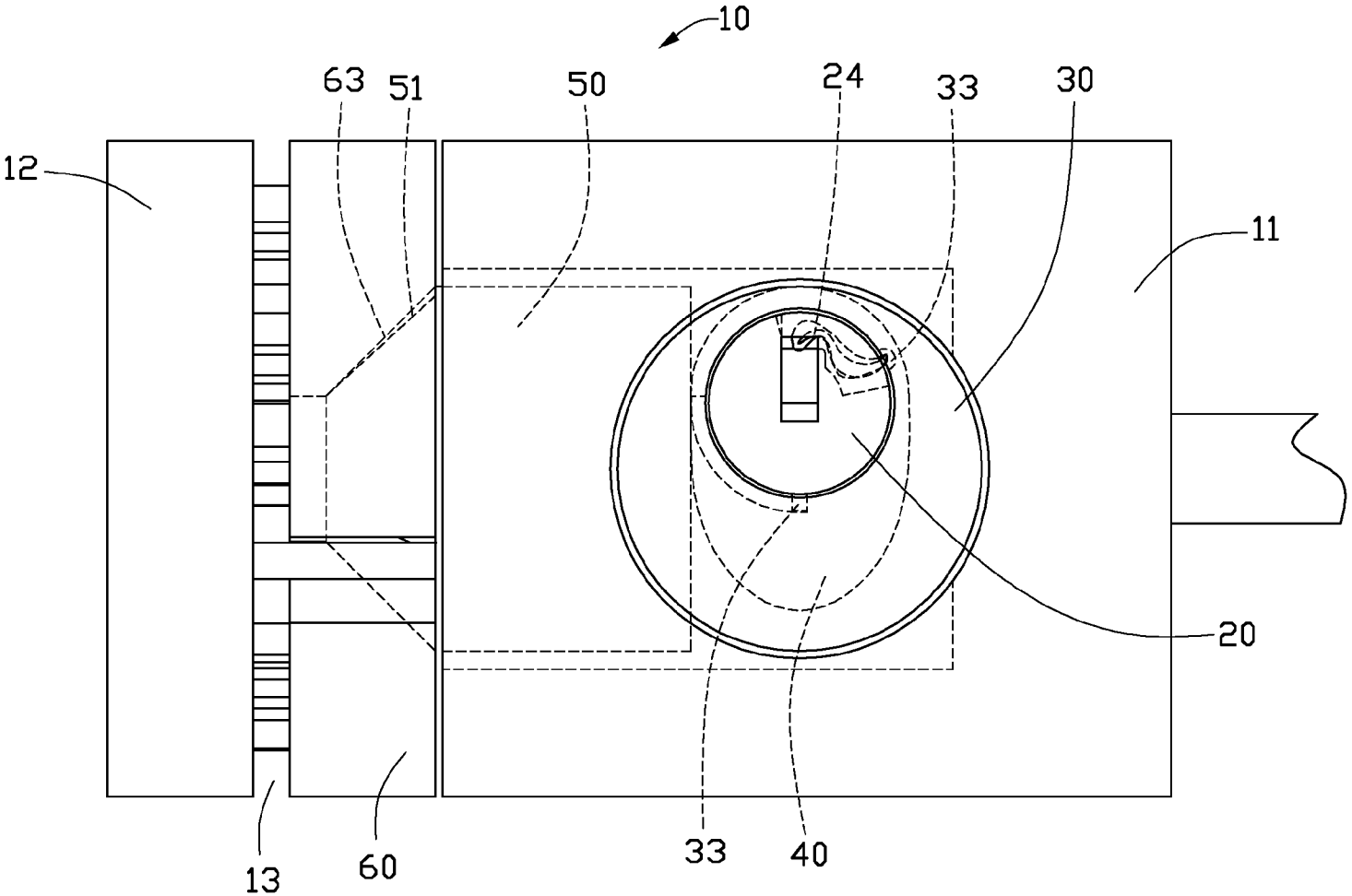
FIG. 8 is a side view of the lock of FIG. 1, showing some elements of the lock in broken lines.

Referring also to FIGS. 6-8, The following description is employed for illustrating the process of assembling the lock 10. A first step is to place the cam 40 in the first receiving space 15. A second step is to secure the lock cylinder holder 30 to the sidewall of the first receiving space 15. A third step is to place each of the hook members 24 and the second elastic members 26 into one of the slots 22 and pass the shaft 25 through the lock cylinder 20 to connect the hook members 24 and the second elastic members 26 to the lock cylinder 20. The hook members 24 are arranged between the second elastic members 26. The hooks of the hook members 24 facing the key hole 21 are coplanar with each other. A fourth step is to pass the lock cylinder 20 through the through hole 31 and place the T-shaped projection 23 into the T-shaped opening 41 to secure the lock cylinder 20 to the cam 40. After the lock cylinder 20 is secured to the cam 40, the hook of each of the hook members 24 facing the key hole 21 is caused to be received in the key hole 21, the other hooks are caused to be received in one column of the recessed portions 33 due to the spring force of the second elastic members 26, thus the lock cylinder 20 cannot be rotated with respect to the lock cylinder holder 30. A fifth step is to place the resisting shaft 50 in the second receiving space 16. A sixth step is to latch the first elastic members 62 via the first latching protrusions 17 and the second latching protrusions 61. The last step is to secure the cover 12 to the housing 11.

After assembling, the latching blocks 60 are retained within the gap 13 until a key is applied.

When a key is inserted into the key hole 21, the key engages the hook members 24 to cause the hook members 24 to rotate around the shaft 25 until the hooks received in one of the columns of the recessed portions 33 move out of the one of the columns of the recessed portions 33. At this point, the lock cylinder 20 can rotate with respect to the lock cylinder holder 30. The key is rotated clockwise to cause the lock cylinder 20 and the cam 40 to rotate clockwise. As the cam 40 rotates clockwise, the cam 40 resists the resisting shaft 50 to cause the resisting shaft 50 to move towards the latching blocks 60. As the resisting shaft 50 moves towards the latching blocks 60, the frustum shaped end 51 of the resisting shaft 50 resists the inclined surfaces 63 of the latching blocks 60, causing each of the latching blocks 60 to move away from the axis of the lock 10. As the lock cylinder 20 and the cam 40 rotate to an ultimate position, one hook of each of the hook members 24 faces to each of the other column of the recessed portions 33, and the latching blocks 60 extend out of the gap 13. After that, the key can be pulled out of the key hole 21, the hooks facing to the other column of the recessed portions 33 are caused to be received in the other column of the recessed portions 33, and the other hooks are caused to be received in the key hole 21 due to the spring force of the second elastic members 26. At this point, further rotation of the lock cylinder 20 and the cam 40 is thus prevented, and each of the latching blocks 60 stays in an extended state. Therefore, the latching blocks 60 can resist some portion of an external device, and the lock 10 can lock the external device.

To open the lock 10, the key is inserted into the key hole 21 and is rotated counterclockwise. The cam 40 does not resist the resisting shaft 50. The resisting shaft 50 moves towards the cam 40 until the spring force of the first elastic members 62 is relieved and the frustum shaped end 51 no longer resists the latching blocks 60. Once the resisting shaft 50 no longer resists the latching blocks 60, the latching blocks 60 return to their original positions due to the spring force of the first elastic members 62.

Figure 9:
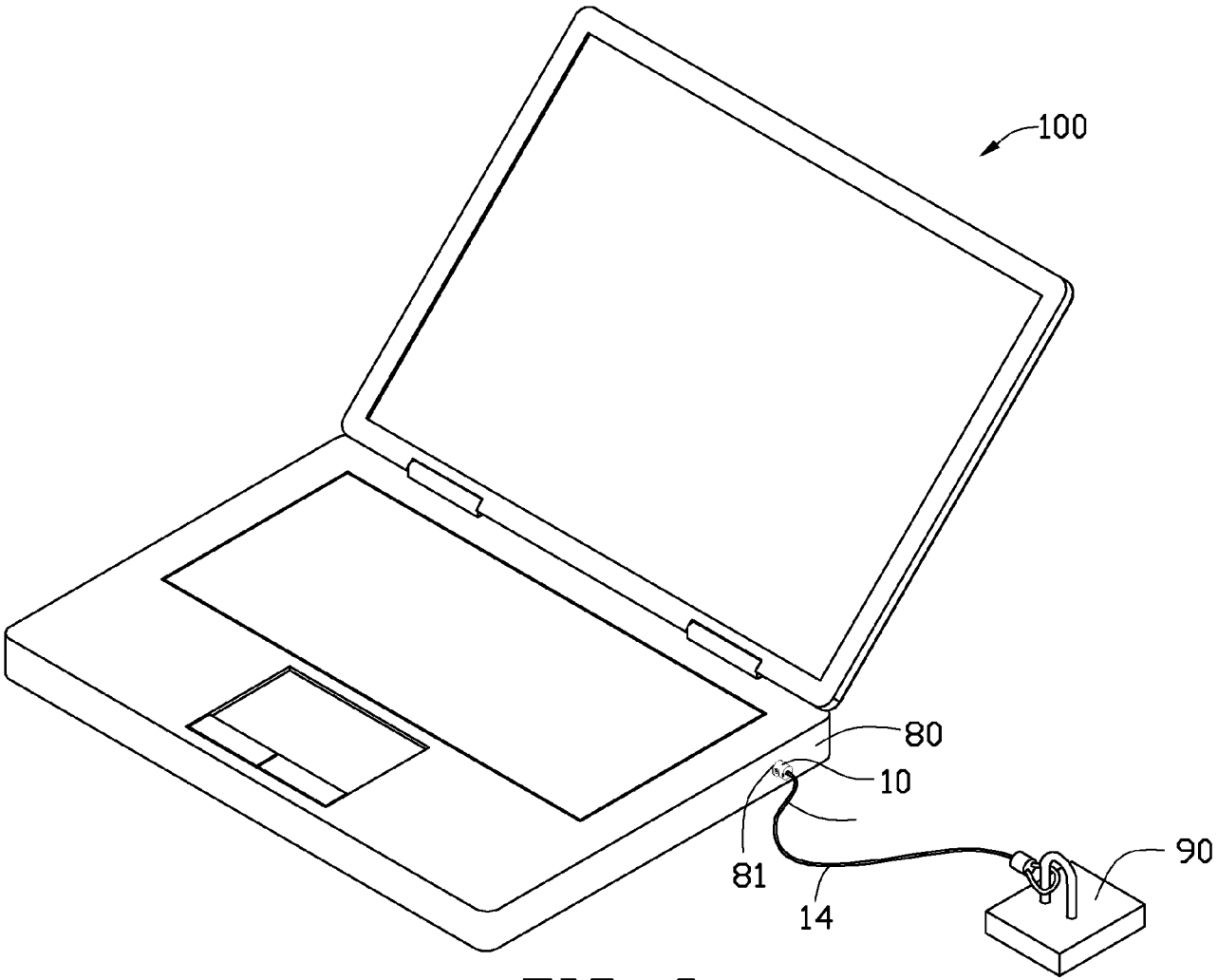
FIG. 9 is an isometric view of an electronic device in accordance with an exemplary embodiment, showing the electronic device using the lock of FIG. 1.
Figure 10:
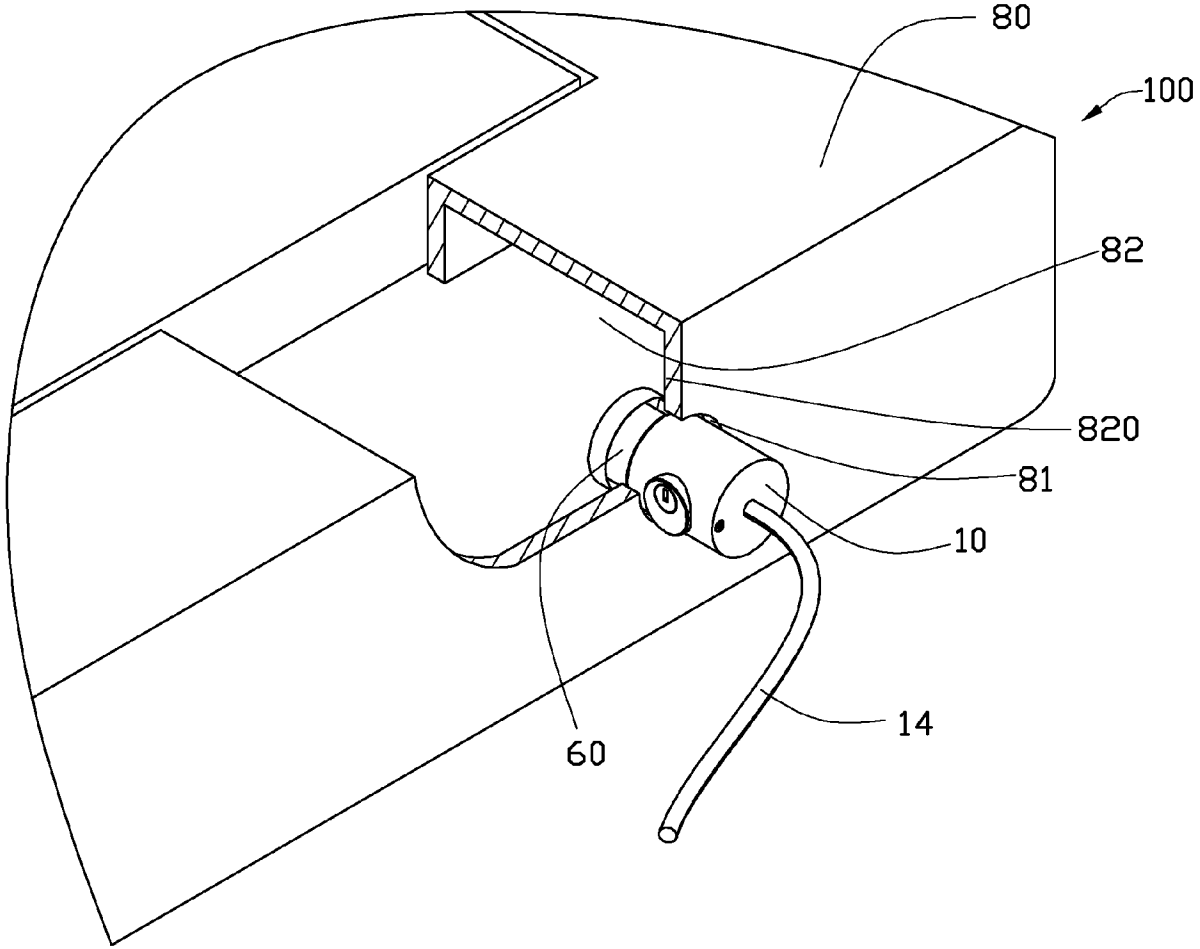
FIG. 10 is a partially enlarged, cut-away view of the electronic device of FIG. 9.

Referring also to FIGS. 9-10, an embodiment of an electronic device 100 is illustrated. The electronic device 100 includes a main body 80 and the lock 10. One sidewall of the main body 80 defines a lock hole 81. The lock hole 81 extends from the sidewall of the main body 80 to a depth to accommodate the cover 12 and the latching blocks 60. A cavity 82 is formed in the main body 80. The cavity 82 communicates with the lock hole 81 to cause the latching blocks 60 to expose to the lock hole 81.

When using the lock 10 to lock the electronic device 100, one end of the cable 14 is fixed to an external apparatus 90, the lock 10 is inserted into the lock hole 81. The key is inserted into the key hole 21 to cause the latching blocks 60 to resist one sidewall 820 of the cavity 82, thus the lock 10 locks the electronic device 100.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A lock, comprising:

a housing;

a cover secured to one end of the housing, wherein a gap is formed between the cover and the housing;

a lock cylinder holder secured to the housing;

a lock cylinder rotatably mounted in the lock cylinder holder;

a cam received in the housing and secured to the lock cylinder;

a resisting shaft rotatably mounted in the housing and comprising a frustum shaped end;

at least one latching block received in the gap, wherein each of the at least one latching block comprises an inclined surface corresponding to the frustum shaped end; and at least one first elastic member connecting the at least one latching block to the cover;

wherein, at least one first latching protrusion protrudes from the cover, and at least one second latching protrusion protrudes from the latching block and faces the at least one first latching protrusion, each of the at least one first latching protrusion cooperates with each of the at least one second latching protrusion to latch each of the at least one first elastic element.

2. The lock as described in claim 1, wherein when the cam rotates with the lock cylinder towards a predetermined direction, the cam resists the resisting shaft to cause the resisting shaft to move towards the at least one latching block until the frustum shaped end of the resisting shaft resists the at least one inclined surface of the at least one latching block, as the at least one latching block is resisted by the resisting shaft, the at least one latching block is caused to extend out of the gap.

3. The lock as described in claim 2, wherein when the cam rotates with the lock cylinder towards an opposite direction, the cam does not resist the resisting shaft, the resisting shaft moves towards the cam until the spring force of the at least one first elastic member is relieved and the frustum shaped end of the resisting shaft no longer resists the at least one latching block, once the resisting shaft no longer resists the at least one latching block, the at least one latching block is caused to be retained within the gap due to the spring force of the at least one first elastic member.

4. The lock as described in claim 1, wherein the housing defines a first receiving space and a second receiving space, the first receiving space is perpendicular to and communicates with the second receiving space, the cam and the lock cylinder holder are received in the first receiving space, and the resisting shaft is received in the second receiving space.

5. The lock as described in claim 1 further comprising at least one hook member and at least one second elastic member, wherein the lock cylinder defines a key hole extending along an axis of the lock cylinder, a sidewall of the lock cylinder defines at least one slot communicating with the key hole, each of the at least one hook member and each of the at least one second elastic member are mounted in one of the at least one slot, the lock cylinder holder defines a through hole to receive the lock cylinder, two columns of recessed portions are formed in a lateral sidewall of the through hole, one end of each of the at least one hook member can be caused to be received in the key hole and an opposite end of each of the at least one hook member can be caused to be received in one recessed portion of one of the columns of the recessed portions due to the spring force of the at least one second elastic member.

6. The lock as described in claim 5, wherein once one end of each of the at least one hook member is caused to be received in the key hole and the opposite end of each of the at least one hook member is caused to be received in one recessed portion of one of the columns of the recessed portions, the lock locks an external device, and once one end of each of the at least one hook member is caused to be received in the key hole and the opposite end of each of the at least one hook member is caused to be received in one recessed portion of the other column of the recessed portions, the lock unlocks the external device.

7. The lock as described in claim 1 further comprising a cable, wherein one end of the cable is secured to one end of the housing.

8. An electronic device, comprising:

a main body defining a lock hole and a cavity communicating with the lock hole; and a lock able to be received in the lock hole, wherein the lock comprises:

a housing;

a cover secured to one end of the housing, wherein a gap is formed between the cover and the housing;

a lock cylinder holder secured to the housing;

a lock cylinder rotatably mounted in the lock cylinder holder;

a cam received in the housing and secured to the lock cylinder;

a resisting shaft rotatably mounted in the housing and comprising a frustum shaped end;

at least one latching block received in the gap, wherein each of the at least one latching block comprises an inclined surface corresponding to the frustum shaped end, the at least one latching block exposes to the lock hole of the main body; and at least one first elastic member connecting the at least one latching block to the cover;

wherein, at least one first latching protrusion protrudes from the cover, and at least one second latching protrusion protrudes from the latching block and faces the at least one first latching protrusion, each of the at least one first latching protrusion cooperates with each of the at least one second latching protrusion to latch each of the at least one first elastic element.

9. The electronic device as described in claim 8, wherein when the cam rotates with the lock cylinder towards a predetermined direction, the cam resists the resisting shaft to cause the resisting shaft to move towards the at least one latching block until the frustum shaped end of the resisting shaft resists the at least one inclined surface of the at least one latching block, once the at least one latching block is resisted by the resisting shaft, the at least one latching block is caused to extend out of the gap, thus the at least one latching block resists a sidewall of the cavity.

10. The electronic device as described in claim 9, wherein when the cam rotates with the lock cylinder towards an opposite direction, the cam does not resist the resisting shaft, the resisting shaft moves towards the cam until the spring force of the at least one first elastic member is relieved and the frustum shaped end of the resisting shaft no longer resists the at least one latching block, once the resisting shaft no longer resists the at least one latching block, the at least one latching block is caused to be retained within the gap due to the spring force of the at least one first elastic member.

11. The electronic device as described in claim 8, wherein the housing defines a first receiving space and a second receiving space, the first receiving space is perpendicular to and communicates with the second receiving space, the cam and the lock cylinder holder are received in the first receiving space, and the resisting shaft is received in the second receiving space.

12. The electronic device as described in claim 8 further comprising at least one hook member and at least one second elastic member, wherein the lock cylinder defines a key hole extending along an axis of the lock cylinder, a sidewall of the lock cylinder defines at least one slot communicating with the key hole, each of the at least one hook member and each of the at least one second elastic member are mounted in one of the at least one slot, the lock cylinder holder defines a through hole to receive the lock cylinder, two columns of recessed portions are formed in a lateral sidewall of the through hole, one end of each of the at least one hook member can be caused to be received in the key hole and an opposite end of each of the at least one hook member can be caused to be received in one recessed portion of one of the columns of the recessed portions due to the spring force of the at least one second elastic member.

13. The electronic device as described in claim 12, wherein once one end of each of the at least one hook member is caused to be received in the key hole and the opposite end of each of the at least one hook member is caused to be received in one recessed portion of one of the columns of the recessed portions, the lock locks an external device, and once one end of each of the at least one hook member is caused to be received in the key hole and the opposite end of each of the at least one hook member is caused to be received in one recessed portion of the other column of the recessed portions, the lock unlocks the external device.

14. The electronic device as described in claim 8 further comprising a cable, wherein one end of the cable is secured to one end of the housing.

* * * * *